US007400084B2

(12) United States Patent
Park et al.

(10) Patent No.: US 7,400,084 B2
(45) Date of Patent: Jul. 15, 2008

(54) ELECTRON EMISSION DISPLAY

(75) Inventors: Zin Min Park, Cheonan (KR); Jong Sick Choi, Suwon (KR); Seung Joon Yoo, Suwon (KR); Soo Joung Lee, Anyang (KR); Jung Ho Kang, Yongin (KR); Su Kyung Lee, Cheonan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 269 days.

(21) Appl. No.: 11/286,148

(22) Filed: Nov. 22, 2005

(65) Prior Publication Data

US 2006/0132022 A1 Jun. 22, 2006

(30) Foreign Application Priority Data

Nov. 29, 2004 (KR) ..... 10-2004-0098752

(51) Int. Cl.
*H01J 1/62* (2006.01)

(52) U.S. Cl. ..... 313/495; 313/461
See application file for complete search history.

(58) Field of Classification Search ..... 313/461, 313/463, 466, 473, 495

(56) References Cited

U.S. PATENT DOCUMENTS

| | | | | |
|---|---|---|---|---|
| 5,489,816 | A * | 2/1996 | Lee | 313/466 |
| 6,819,041 | B2 * | 11/2004 | Kajiwara | 313/496 |
| 2003/0111946 | A1 | 6/2003 | Talin et al. | |
| 2004/0130258 | A1 * | 7/2004 | Oh | 313/495 |

* cited by examiner

*Primary Examiner*—Vip Patel
(74) *Attorney, Agent, or Firm*—Christie, Parker & Hale, LLP

(57) ABSTRACT

An electron emission display including an electron emission substrate having at least one electron emission device formed thereon and an image forming substrate spaced apart from the electron emission substrate. The image forming substrate includes an effective region where electrons emitted from the electron emission device collide with the effective region to form images and a black region surrounding the effective region. The effective region includes a fluorescent layer formed in an arbitrary pattern and a metal layer formed on the fluorescent layer. The metal layer has a structure extending onto at least a portion of the black region.

20 Claims, 8 Drawing Sheets

ELECTRON EMISSION DISPLAY

CROSS-REFERENCE TO RELATED APPLICATION

This application claims priority to and the benefit of Korean Patent Application No. 2004-98752, filed Nov. 29, 2004, the disclosure of which is hereby incorporated herein by reference in its entirety.

BACKGROUND

1. Field of the Invention

The present invention relates to an electron emission display and, more particularly, to an electron emission display capable of increasing brightness by extending a metal reflection layer of an effective region onto a black region in an image forming substrate that includes the effective region for forming images and the black region surrounding the effective region.

2. Discussion of Related Art

In general, an electron emission device uses a hot cathode or a cold cathode as an electron source. The electron emission device using the cold cathode may be a field emitter array (FEA) type device, a surface conduction emitter (SCE) type device, a metal-insulator-metal (MIM) type device, a metal-insulator-semiconductor (MIS) type device, a ballistic electron surface emitting (BSE) type device or a similar device.

These types of electron emission devices may be used in an electron emission display along with various types of backlights, an electron beam apparatus for lithography and similar components. The electron emission display has an electron emission region that includes an electron emission device to emit electrons and an image forming region for receiving the emitted electron at a fluorescent layer that emits light in response. Generally, the electron emission display includes a plurality of electron emission devices and driving electrodes for controlling the electron emission of the electron emission devices on an electron emission substrate. The electron emission display includes fluorescent layers and electrodes connected to the fluorescent layers for allowing the electrons emitted from the electron emission substrate to be effectively accelerated toward the fluorescent layers that are formed on an image forming substrate.

In this electron emission display, an increase in brightness is always considered an important issue. Specifically, it is important if it is possible to manufacture an electron emission display capable of obtaining excellent performance where the brightness can be increased without employing complicated manufacturing methods, and where other factors such as anode voltage, anode structure, cathode structure and similar factors remain in the same condition.

SUMMARY

The embodiments of the present invention provide an electron emission display having a structure capable of increasing brightness.

In one exemplary embodiment of the present invention, an electron emission display includes a first substrate having at least one electron emission device formed thereon and a second substrate formed spaced apart from the first substrate. The second substrate includes an effective region where electrons emitted from the electron emission device collide with the effective region to form images and a black region surrounding the effective region. The effective region includes a fluorescent layer formed with an arbitrary pattern and a metal layer formed on the fluorescent layer. The metal layer has a structure extending onto at least a portion of the black region.

In another embodiment of the present invention, an electron emission display includes a first substrate having at least one electron emission device formed thereon and a second substrate spaced apart from the first substrate. The second substrate includes a fluorescent material region and a light-shielding layer region formed in a predetermined pattern to allow electrons emitted from the electron emission device to collide with each other to form images. The second substrate also includes a black region entirely surrounding the fluorescent material region and having a predetermined thickness and a metal layer formed on the fluorescent material region and the light-shielding layer region. The metal layer has a structure extending to at least a portion of the black region.

The metal layer of the electron emission display may function as an anode electrode between the second substrate and the fluorescent layer. The metal layer may have a structure entirely covering the black region or partially covering the black region.

DETAILED DESCRIPTION

Figure 1:
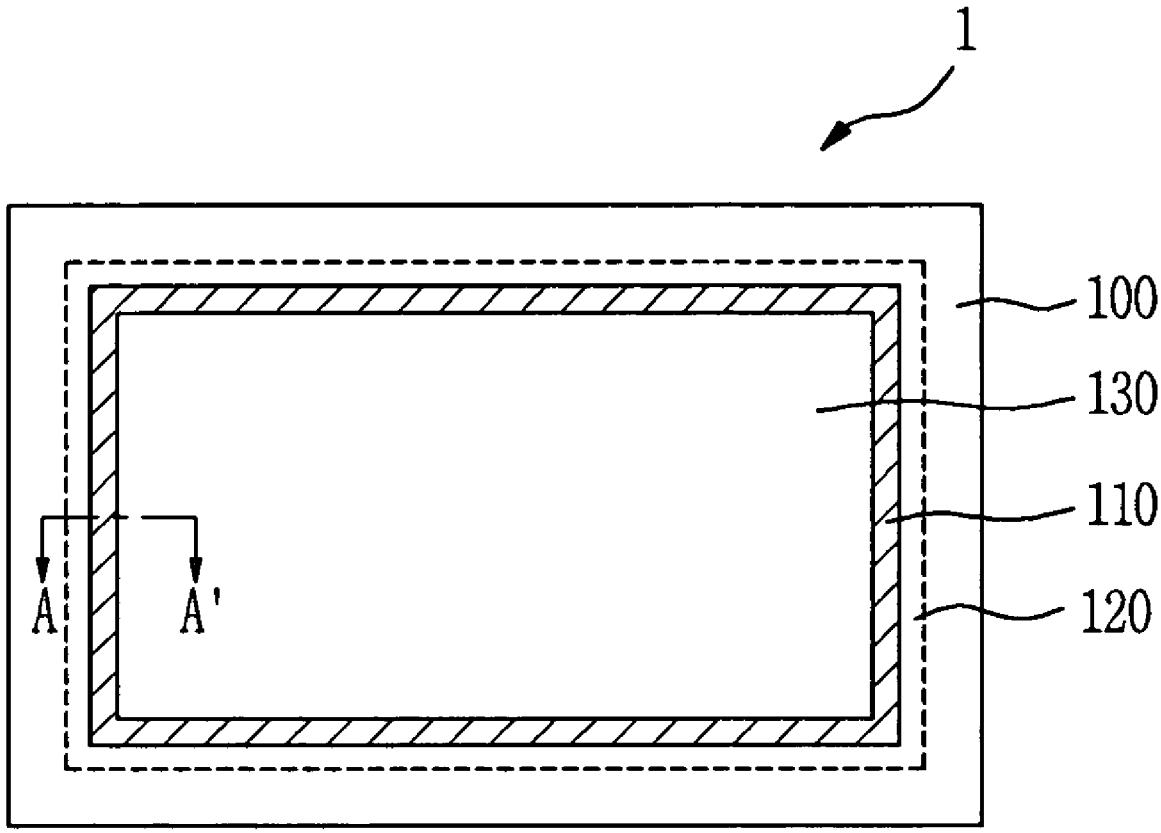
FIG. 1 is a schematic plan view of an electron emission display in accordance with an embodiment of the present invention.

Referring to FIG. 1, the electron emission display 1 includes an electron emission substrate having at least one electron emission device formed thereon, and an image forming substrate for allowing electrons emitted from the electron emission substrate and the electron emission device to collide with each other to form images. FIG. 1 schematically illustrates only a part of the image forming substrate 100 for clarity.

The image forming substrate of the electron emission display 1 includes an effective region 130 for the emitted electrons to collide with to form the images and a black region 110 surrounding the effective region 130. In addition, referring to FIG. 2, the effective region 130 includes fluorescent layers 150 separately formed in a predetermined shape, and a metal layer 120 formed on the fluorescent layers 150. In one embodiment, the metal layer 120 has a structure extending onto at least a portion of the black region 110. The metal layer 120 may have a structure covering the black region 110 to a position P on the black region 110. In another embodiment, the metal layer 120 may be formed to extend to the Q position.

Figure 2:
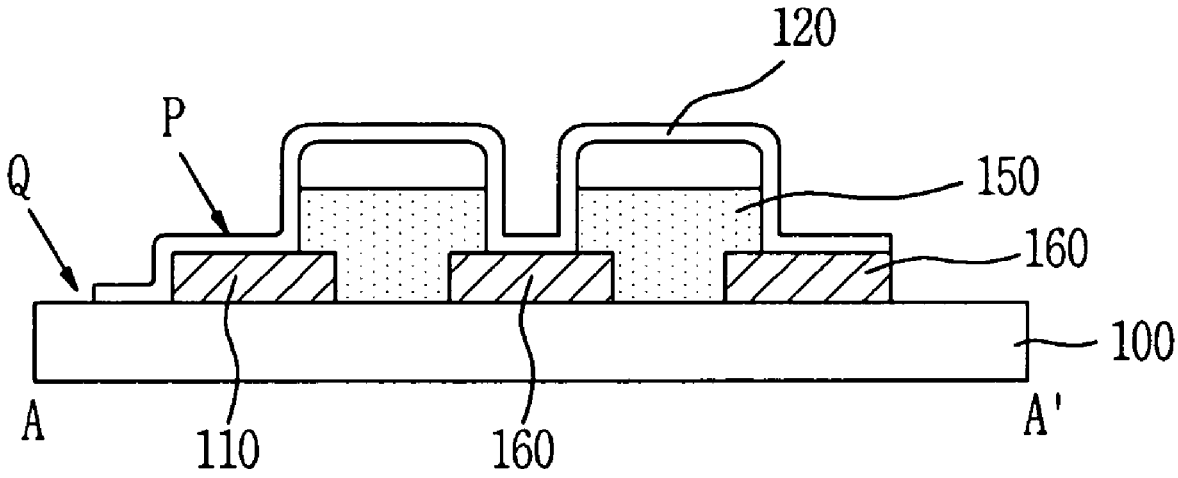
FIG. 2 shows an example of a cross-sectional view taken along the line A-A' of the image forming substrate in FIG. 1.

The "effective region" refers to a region where visible light is formed by a collision with electrons from the electron emission device. In FIG. 2, the black region 160 may be partially formed within the effective region 130. In contrast with the effective region 130, the "black region" refers to a region that is not intended to emit visible light by the collision of electrons. The black region 110 may have a width, for example, in the range from several to several tens of μm. The black region 110 may include all those areas formed at the outermost periphery of the image forming substrate that perform a light-shielding function.

The metal layer 120 at least partially covers the black region 110. Charges generated by the collision of the electrons with the fluorescent layers 150 can escape through the metal layer 120 to improve the brightness of the electron emission display. Therefore, when a material of the black region is a non-conductive material, the black region 110 has a greater effect.

For example, the image forming substrate 100 may be made of a material such as conventional glass or glass having reduced impurities such as Na or similar impurities or may be a ceramic substrate, a plastic substrate, or similar substrate.

Referring to FIG. 2 while describing a manufacturing process of the image forming substrate 100, first a black region 160 within an effective region 130 and a black region 110 on the outer periphery are formed using a non-conductive black material such as black Fodel available from Dupont Ltd. For example, the black regions 110 and 160 may be formed by applying, exposing, developing and patterning a non-conductive photosensitive paste containing a black pigment or may be formed by depositing and patterning a non-permeable dielectric to a thickness of 1 to 20 μm using a vacuum deposition method or a sputtering method. In another embodiment, the black regions 110 and 160 may be formed as conductive black regions.

Next, red (R), green (G) and Blue (B) fluorescent materials are applied into openings, which the black regions define, to form fluorescent layers 150. In one embodiment, the fluorescent layers 150 are formed to a thickness of about 10 μm and remain in the open regions defined by the black regions 110 and 160. The fluorescent layers 150 may be formed by preparing a fluorescent paint and then applying and plasticizing the paint on an entire surface of the substrate using a slurry method. Then, a sacrificial layer (not shown) is applied onto the entire surface of the substrate or applied and then patterned. Next, when an anode voltage of 4~5 kV is applied, a metal layer 120 is deposited to a thickness capable of transmitting electrons along the entire surface and blocking secondary electrons, i.e., a thickness ranging from several hundred Å to several thousands of Å. The metal layer 120 may be aluminum, nickel, cobalt, copper, iron, gold, silver, rhodium, palladium, platinum, zinc or alloys thereof. In an example embodiment, the metal layer 120 is formed of aluminum. Next, the sacrificial layer (not shown) is removed by the plasticizing.

The fluorescent layers 150 have, for example, stripe shapes, and the emitted electrons collide with the fluorescent layers to emit light. The fluorescent layers 150 may have stripe shapes or dotted shapes. Black regions 110 and 160 prevent light of other colors from emitting between the fluorescent layers 150.

Figure 3:
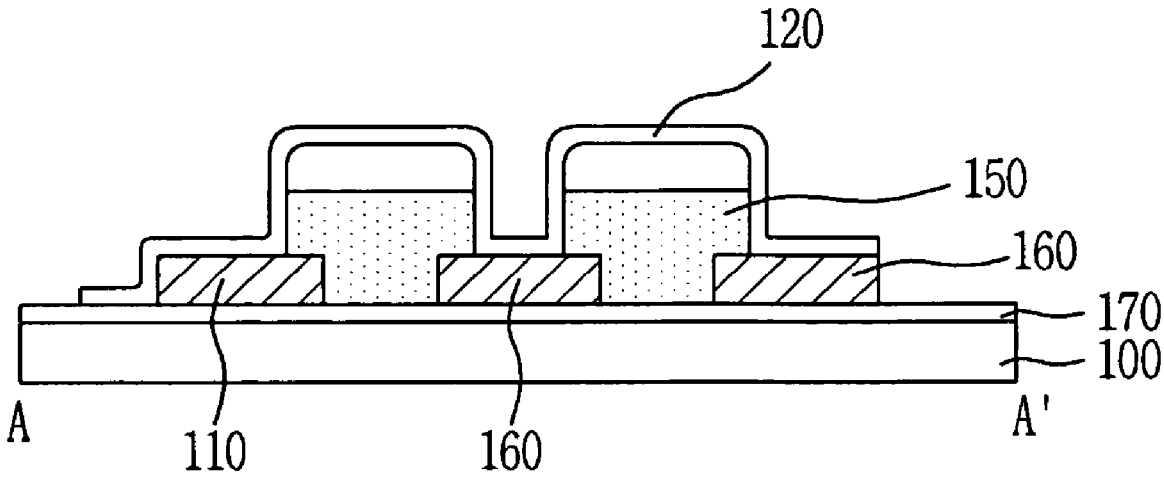
FIG. 3 shows another example of a cross-sectional view taken along the line A-A' of the image forming substrate in FIG. 1.

FIG. 3 shows another example of a cross-sectional view taken along the line A-A' of the image forming substrate in FIG. 1. For the convenience of the description, the differences from FIG. 2 will mainly be described below. FIG. 3 further includes a transparent conductive layer 170 between the substrate 100 and the black regions 110 and 160.

The transparent conductive layer 170 may be formed with an integrated shape, a stripe shape, a separated shape or the like, and deposited to a thickness ranging from several hundreds Å to several thousands Å using transparent conductive oxide such as indium tin oxide (ITO) or indium zinc oxide (IZO). It is possible to form a thin metal layer having transparency. It is also possible to manufacture the black regions by depositing ITO, depositing metal such as Cr on the ITO and plasticizing the ITO.

Figure 4:
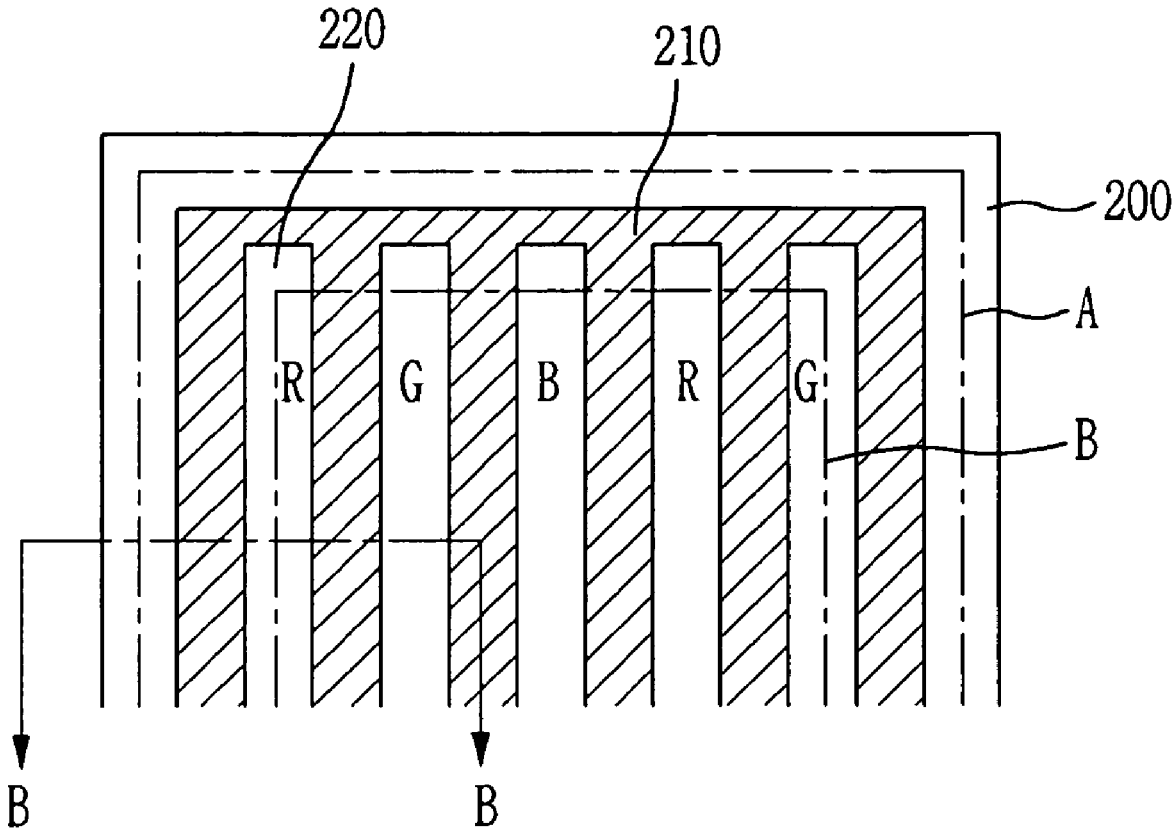
FIG. 4 is a schematic plan view of an image forming substrate in accordance with another embodiment of the present invention.
Figure 5:
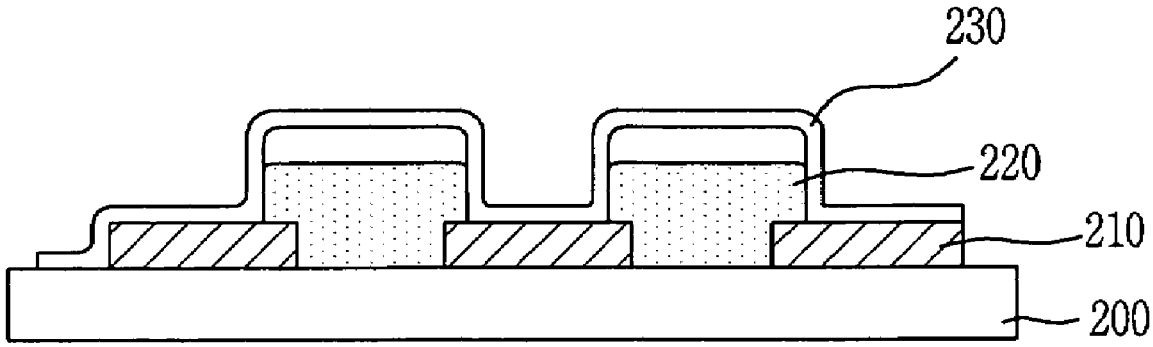
FIG. 5 is a cross-sectional view taken along the line B-B' of the image forming substrate in FIG. 4.
Figure 6:
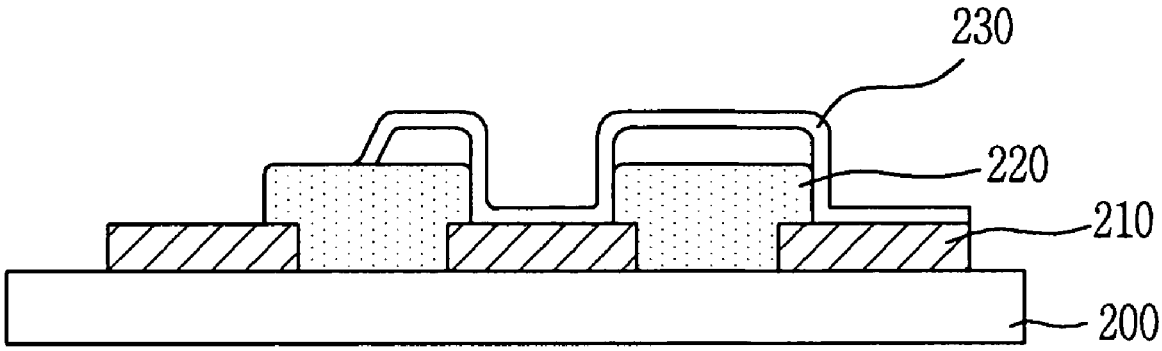
FIG. 6 is a cross-sectional view taken along the line B-B' of the image forming substrate in FIG. 4.

FIG. 4 is a schematic plan view of an image forming substrate in accordance with another embodiment of the present invention. FIGS. 5 and 6 are cross-sectional views taken along the line B-B' of the image forming substrate in FIG. 4. FIG. 5 depicts a structure (structure A) where a metal layer covers the entire black region as shown in FIG. 4. FIG. 6 depicts a structure (structure B) where the metal layer does not entirely cover the black region.

Referring to FIG. 5, the image forming substrate includes fluorescent material regions 220 separately formed having a predetermined shape for the emitted electrons to collide with to emit light. Black regions 210 surround the fluorescent material regions 220 and are formed on the outermost periphery to have a predetermined thickness. A metal layer 230 is formed on the fluorescent material regions 220 and the black regions 210. The metal layer 230 has a structure that entirely covers the black regions 210 formed on the outermost periphery and has a predetermined thickness. In another embodiment, the black regions 210 may be formed only at the periphery, and may be not be formed between the fluorescent material regions 220.

Figure 7:
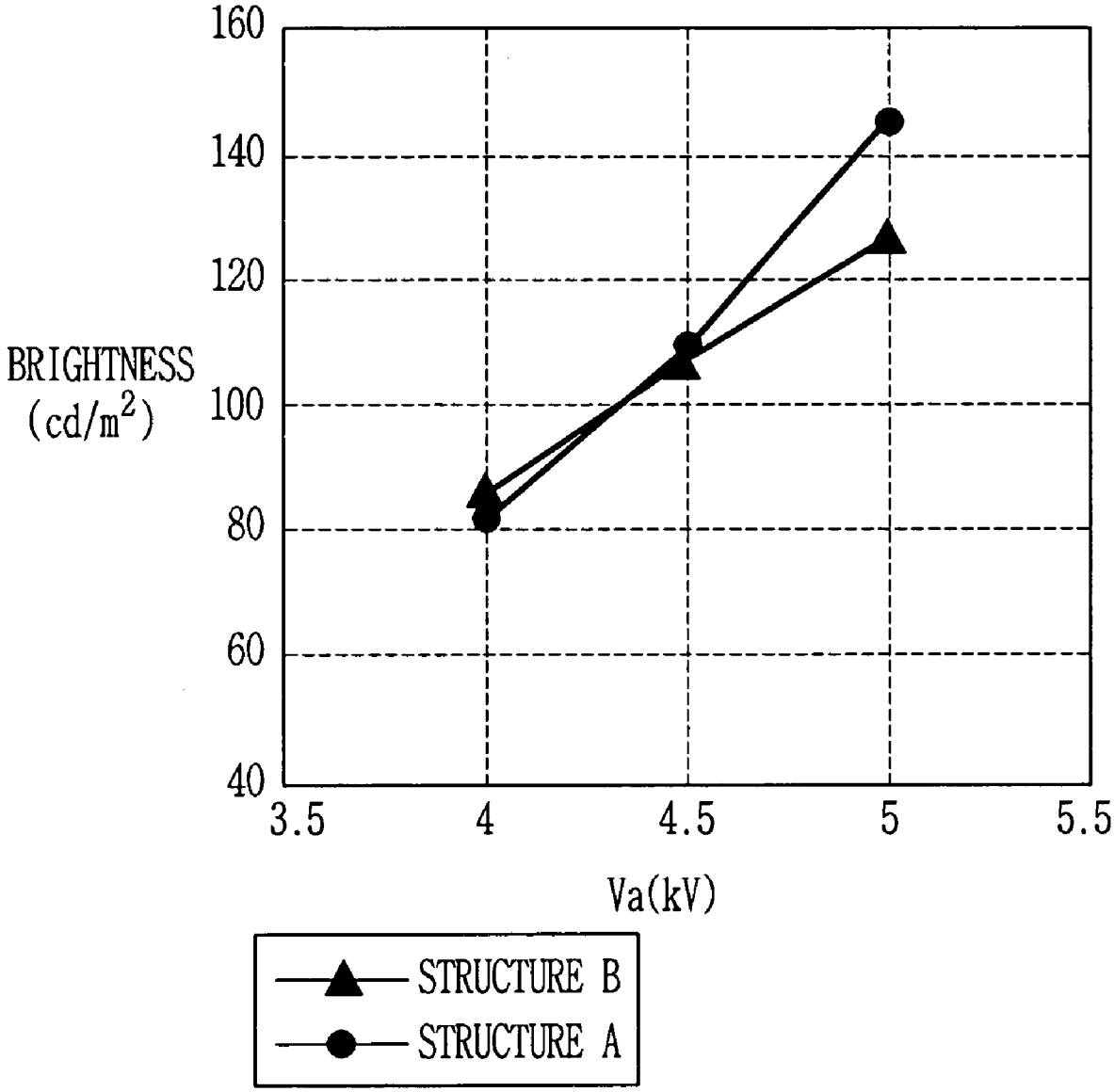
FIG. 7 is a graph comparing the degree of brightness that varies depending on an anode voltage applied to a metal layer in the image forming substrate in FIGS. 5 and 6.

FIG. 7 is a graph comparing the degree of brightness, which varies depending on an anode voltage applied to the metal layer 230 depicted in FIGS. 5 and 6. The brightness of structure A dramatically increases in comparison with that of structure B, when the anode voltage is greater than 4.5 kV. A continuous charge accumulation phenomenon may be generated as the electrons collide with the fluorescent material region 220. The phenomenon is attenuated due to the metal layer to thereby improve the luminous efficiency of the fluorescent material.

Figure 8:
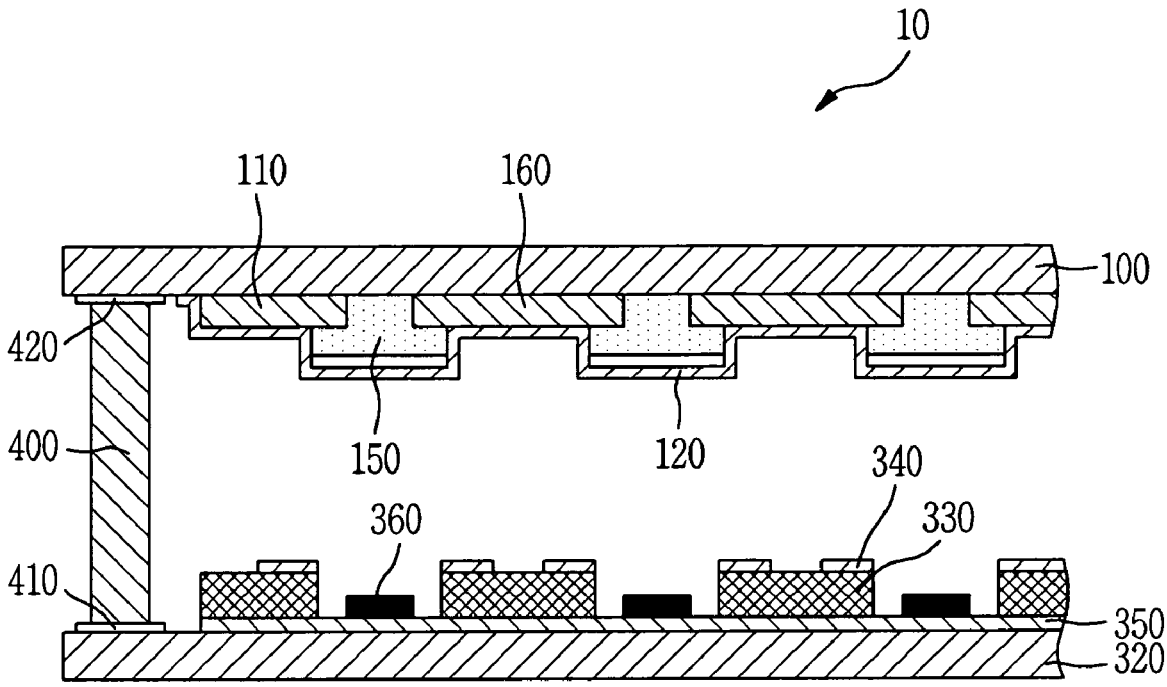
FIG. 8 is a schematic cross-sectional view of a portion of an electron emission display in accordance with an exemplary embodiment of the present invention.

FIG. 8 is a schematic cross-sectional view of a portion of an electron emission display 10 in accordance with an exemplary embodiment of the present invention. The electron emission display of FIG. 8 illustrates one embodiment in which the image forming substrate in FIG. 2 is employed.

In FIG. 8, the electron emission display includes an image forming substrate, an electron emission substrate, and a spacer 400 for supporting the substrates. The electron emission substrate 320 and the image forming substrate 100 are supported by a conventional method, for example the spacer 400. The two substrates are spaced apart from each other by a gap of about 200 mm to several mm and disposed substantially parallel to each other. The spacer 400 can be adhered to each substrate using adhesive agents 410 and 420.

A plurality of cathode electrodes 350 having, for example, stripe shapes, are formed in one direction on the electron emission substrate 320 and spaced apart from each other. Each of the cathode electrodes 350 may be made of a transparent conductive material such as ITO. An opening is defined on each cathode electrode 350 by an insulating layer 330 that is formed to a predetermined thickness (for example, 0.1 to several tens of μm). An electron emission portion 360 is formed in the opening. Gate electrodes 340 are formed on the insulating layer 330 to have a thickness of thousands of Å.

The gate electrodes 340 may also have stripe patterns similar to the cathode electrodes 350. The gate electrodes 340 may be spaced apart from each other by an arbitrary gap and disposed perpendicular to the cathode electrodes 350. The electron emission display regions where the cathode electrodes 350 and the gate electrodes 340 intersect each other correspond to pixel regions.

The electron emission portions 360 formed on the cathode electrodes 350 may be made of carbon-based materials such as metal tip, graphite, diamond, diamond like carbon (DLC), C60 (Fulleren), or carbon nano-tube (CNT).

In the electron emission display, when a predetermined voltage is applied to the cathode electrode 350, the gate electrode 340 and the anode electrode 120 (for example, 0 V to the cathode electrode, 80 V to the gate electrode, and 3 kV to the anode electrode), an electric field is created between the cathode electrode 350 and the gate electrode 340 to emit electrons from the electron emission portion 360. The emitted electrons are converted to electron beams that are directed toward the fluorescent layer 150. The collision of the electron beams with the fluorescent layer 150 causes the emission of light.

As can be seen from the foregoing, the example embodiments of the present invention provide a method for fabricating an electron emission display capable of improving electron emission efficiency to increase brightness.

Although the present invention has been described with reference to certain exemplary embodiments thereof, it will be understood by those skilled in the art that a variety of modifications and variations may be made to the exemplary embodiments of the present invention without departing from the spirit or scope of the present invention defined in the appended claims, and their equivalents.

What is claimed is:

1. An electron emission display comprising:

a first substrate having at least one electron emission device thereon; and a second substrate spaced apart from the first substrate and including an effective region where electrons emitted from the at least one electron emission device collide with the effective region to form images and a black region surrounding the effective region, wherein the effective region includes a fluorescent layer in a pattern and a metal layer on the fluorescent layer, and wherein the metal layer extends onto at least a portion of the black region surrounding the effective region.

2. The electron emission display according to claim 1, wherein the metal layer is an anode electrode between the first substrate and the fluorescent layer.

3. The electron emission display according to claim 1, wherein the metal layer has a structure entirely covering the black region.

4. The electron emission display according to claim 1, wherein the black region is made of a non-conductive material.

5. The electron emission display according to claim 1, further comprising:

a black region between fluorescent layers.

6. The electron emission display according to claim 5, wherein the metal layer is an anode electrode between the first substrate and the fluorescent layer.

7. The electron emission display according to claim 5, wherein the metal layer has a structure entirely covering the black region surrounding the effective region.

8. The electron emission display according to claim 5, wherein the black region surrounding the effective region is made of a non-conductive material.

9. An electron emission display comprising:

a first substrate having at least one electron emission device thereon; and a second substrate spaced apart from the first substrate and including a fluorescent material region formed in a predetermined pattern to allow electrons emitted from the electron emission device to collide with the fluorescent material region to form images, a black region surrounding the fluorescent material region and having a thickness at an outermost periphery, and a metal layer on the fluorescent material region and the black region, wherein the metal layer extends onto at least a portion of the black region surrounding the flourescent material region.

10. The electron emission display according to claim 9, wherein the metal layer is an anode electrode between the first substrate and the fluorescent material region.

11. The electron emission display according to claim 9, wherein the metal layer has a structure entirely covering the black region.

12. The electron emission display according to claim 9, wherein the black region is made of a non-conductive material.

13. A device comprising:

an image forming substrate;

a plurality of black regions patterned on the image forming substrate;

a plurality of fluorescent regions patterned on the image forming substrate; and a metal layer entirely covering the plurality of fluorescent regions and at least a portion of the plurality of black regions surrounding the fluorescent regions.

14. The device of claim 13, wherein the metal layer covers the entirety of the plurality of black regions.

15. The device of claim 13, wherein the plurality of fluorescent regions cover a portion of the plurality of black regions.

16. The device of claim 13, wherein a voltage of over 4.5 kilovolts is applied to the metal layer.

17. The device of claim 13, wherein the black regions are made of a non-conductive material.

18. The device of claim 13, further comprising:

an electron emission substrate having an electron emission device coupled to the image forming substrate by a spacer.

19. The device of claim 18, wherein the metal layer is an anode electrode between the electron emission substrate and the plurality of fluorescent regions.

20. The device of claim 19, wherein the electron emission device emits a beam of electrons toward one of the plurality of fluorescent regions.

* * * * *